United States Patent [19]

Lin

[11] Patent Number: 4,708,676

[45] Date of Patent: Nov. 24, 1987

[54] MULTI-FUNCTION PAD DEVICE WITH DRIVING MECHANISM

[76] Inventor: Jinn-Pin Lin, 3rd Fl., No. 29, Alley 25, Lane 109, Mu Cha Rd. Sec. 2, Taipei, Taiwan

[21] Appl. No.: 923,633

[22] Filed: Oct. 27, 1986

[51] Int. Cl.[4] ..... A63C 15/00

[52] U.S. Cl. ..... 441/67; 440/27; 441/131

[58] Field of Search ..... 441/66, 67, 131; 440/27; 114/345; 272/1 B

[56] References Cited

U.S. PATENT DOCUMENTS 4,021,873 5/1977 Francois ..... 114/345

4,451,239 5/1984 Hoenstine et al. ..... 441/67

*Primary Examiner*—Jeffrey V. Nase

*Assistant Examiner*—Jesûs D. Sotelo

*Attorney, Agent, or Firm*—Wenderoth, Lind & Ponack

[57] ABSTRACT

It is a multi-function pad device with driving mechanism; particularly, it is a device including a pad, a buoy ring, a pad sheet and a driving mechanism. Upon different elemental members being assembled in different manners, different functions can be provided for recreation activities. The various assemblies not only can be used on water or ground for recreation activities, but also can be used on snow ground, beach or lawn. Further, the device may also be used as a lifeguard on water and transportation for the aquatic product raiser.

3 Claims, 11 Drawing Figures

MULTI-FUNCTION PAD DEVICE WITH DRIVING MECHANISM

BACKGROUND OF THE INVENTION

This invention relates to a multi-function pad device with a driving mechanism, which is an invention related to U.S. Pat. No. 4,459,714, entitled "Multi-function Cushion and Its Assemblies".

The pad device according to the present invention can provide various useful functions by varying the assembling method; it not only can be used for recreation purposes on water, but also can be used by a lifeguard and an aquatic product raiser. Further, such device can also be used on the snow, the beach and the lawn.

In currently used recreation equipment, there are not many pieces of equipment that can provide multiple functions. For instance, the currently used recreation equipment for use on water include a ring-shaped buoy, an air bed, an inflatable rubber boat, a water bicycle for two persons, and other buoys made of foam materials; most of the aforesaid pieces of equipment are formed into a fixed form for only a single useful purpose without providing any variation and without much recreation. For example, the ring-shaped buoy can only be used for floating one person or two persons at the most; the air bed (or inflation bed) can only be used by a person to lie thereon and float on the water without providing more fun on the water. The inflatable rubber boat, the water bicycle for two persons and other foam material buoys each can only provide one recreation use. It appears that the one piece of equipment for one type of recreation has been unable to satisfy the requirements of the present consumer, since the current consumers want limited economic means developed to its maximum utility, i.e., the principle that one object should provide more functions for economy's sake.

SUMMARY OF THE INVENTION

The prime object of the present invention is to provide a multi-function recreation device by means of a simple member such as a pad, a buoy ring, a pad sheet and a driving mechanism, etc. to be assembled in various ways.

Another object of the present invention is to provide a device, whereby A DIY (do-it-yourself) activity, such as assembling and disassembling, and use, may become popular so as to train one's imagination and to create more practical and recreational activities.

A further object of the present invention is to provide a device, which not only can be used as a multi-use recreation equipment on the water, but also can be used by a lifeguard and aquatic product raisers, etc. for creating additional economic values.

DETAILED DESCRIPTION OF THE PREFERRED EMBODIMENT

Figure 4:
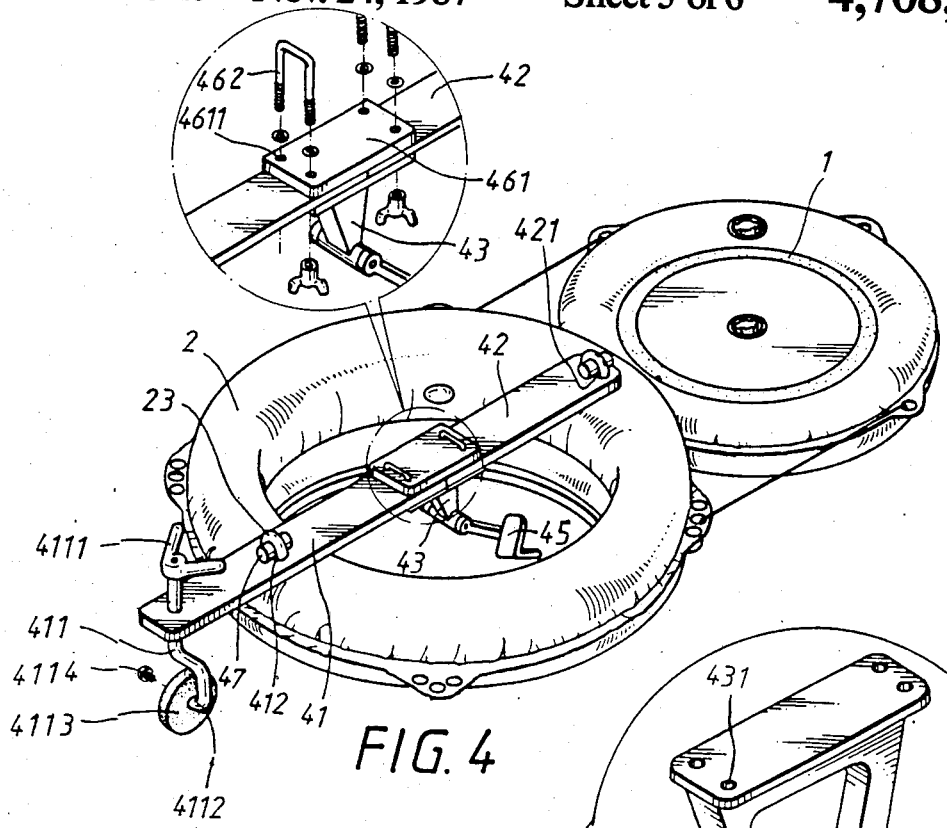
FIG. 4 illustrates the present invention provided with a driving mechanism.
Figure 5:
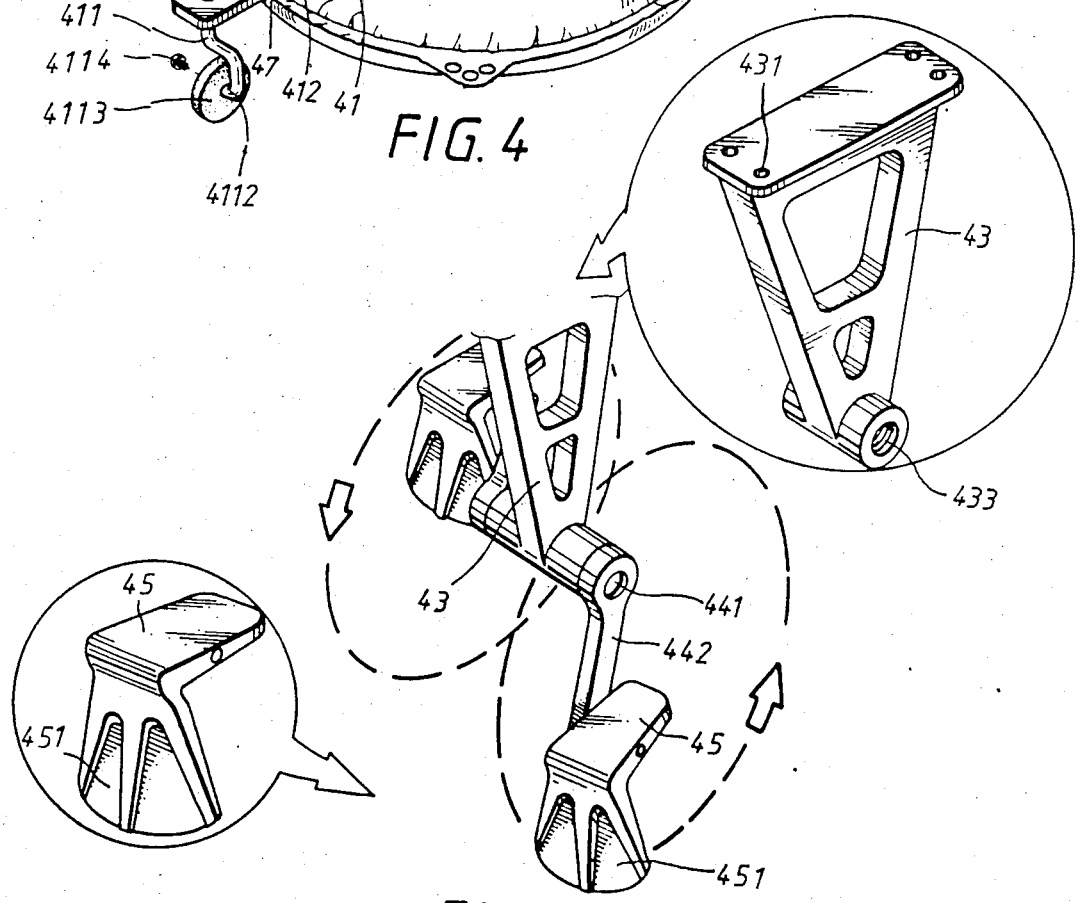
FIG. 5 illustrates the operation of the driving mechanism shown in FIG. 4.

The present invention mainly comprises a pad 1, a buoy ring 2, a pad sheet 3 and a driving mechanism as shown in FIG. 4. The pad 1 includes an inner ring 11 and an outer ring 12 filled with air; the outer edge of the outer ring 12 is furnished with several lugs 121, each of which has a linking hole 1211 so as to be able to be connected with other member of the present invention. The inner ring 11 and the outer ring 12 have discrete air chambers respectively, as well as inflating valves 111 and 122; in case one portion of the inner ring has a leak, the other portion will not be affected.

The buoy ring 2 is substantially an inflated ring-shaped member, the outer edge of which is furnished with several lugs 21, each having several linking holes 211 so as to be able to link with other members of the present invention. Under each of the lugs 21, there is a linking ring 212 in which a supporting rod 48 can be mounted. Under the bottom side of the buoy ring 2, there are two auxiliary air chambers 22, being positioned symmetrically in parallel under both sides of the buoy ring and on diametrically opposite sides thereof; the two auxiliary air chambers are normally in the water so as to provide the ring 2 with a stable and directional effect. On the top side of the buoy ring 2, there are two oarlocks 23, being positioned symmetrically on diametrically opposite sides for holding two oars respectively. There are several projection members 24 furnished on the inside surface of the buoy ring 2 at regular circumferential intervals; under the projection members 24, there is a bottom ring 25 on the inside of buoy ring 2. Between the bottom ring 25 and the projection members 24, the pad 1 can be fastened so as to assemble the pad 1 and the buoy ring 2 together. Since the buoy ring 2 has large dimensions, it includes several discrete air chambers so as to prevent the whole buoy ring from losing buoyancy in case of only one part thereof being damaged; however, the discrete air chamber structure is deemed an obvious means, and therefore it is not shown in the drawings, and not further described.

Figure 1:
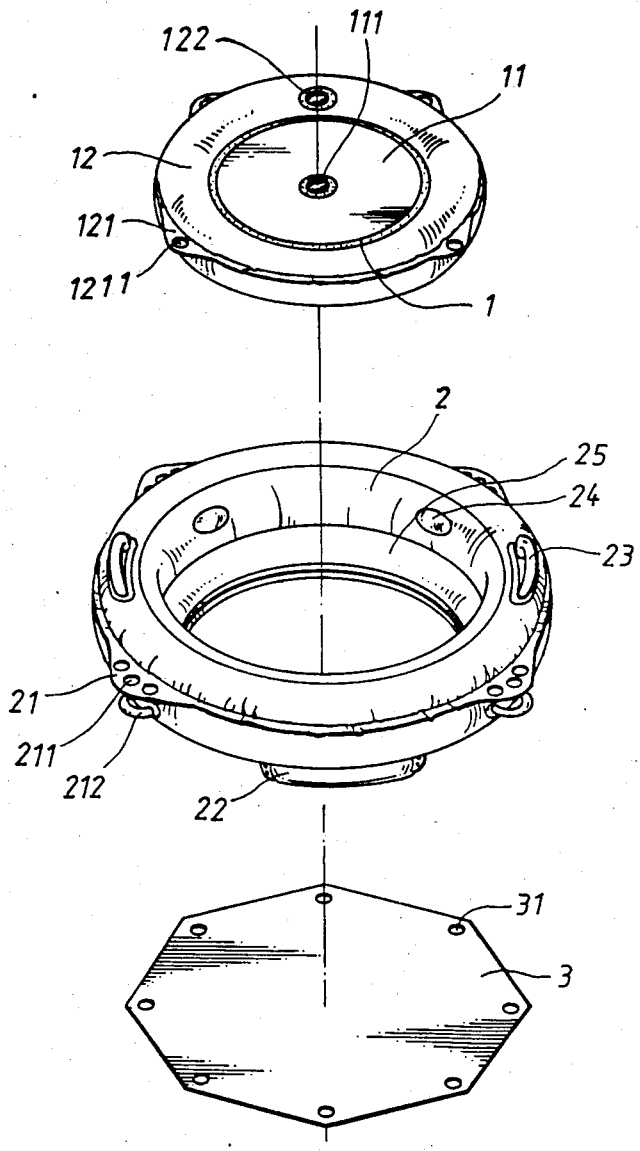
FIG. 1 is an exploded view of an embodiment of the device according to the present invention.
Figure 2:
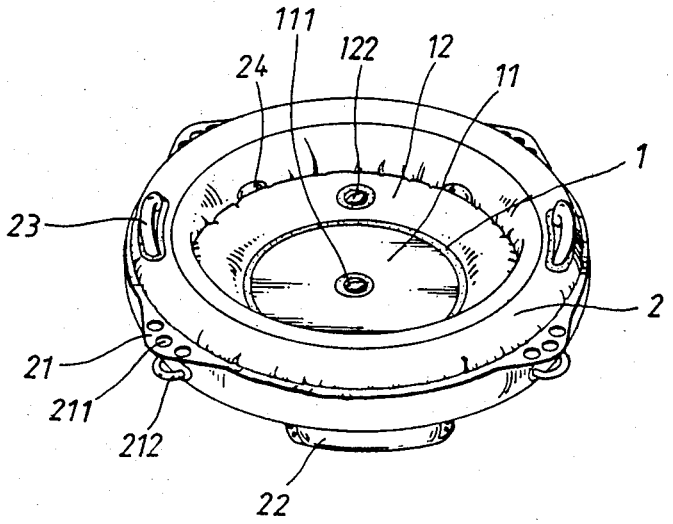
FIG. 2 is a perspective view of the present invention, showing the pad and the buoy ring assembled together.
Figure 3:
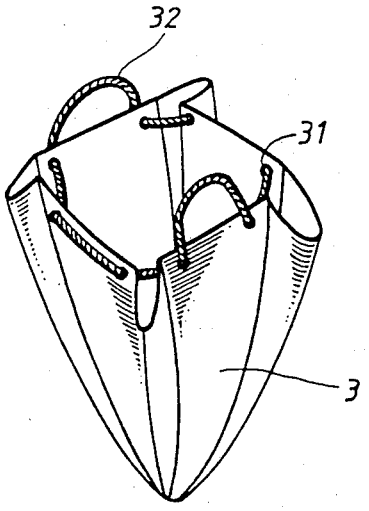
FIG. 3 illustrates the pad sheet being used as a bag.

The pad sheet 3 is made of PVC cloth with meshes or other materials having suitable elasticity and toughness, and is formed into a polygonal sheet with a plurality of rope holes 31 along the edge portion for receiving rope 32; then, it can be used as a bag for carrying the buoy ring 2 and the pad 1 after the air therein has been exhausted and for carrying other articles. When the rope 32 is pulled along the bag opening to pull the edges together, the bag can be carried conveniently as shown in FIG. 3. After the bag has been spread, it can provide more uses after being assembled with other necessary parts.

The driving mechanism as shown in FIG. 4 mainly includes a front plate 41 and a rear plate 42 connected to form the main portion of the driving mechanism as shown in FIG. 4. The outer end of the front plate 41 has a steering member 411 mounted thereon, the top end of which is provided with a handle 4111, while the lower end thereof is bent into a wheel spindle 4112 for mounting a wheel 4113, which is mounted in place with a fastening screw 4114. The steering member 411 is mounted on the front plate 41 in a pivotal manner so as to provide a steering function by means of wheel 4113 upon the overall drive being put in the water. The central portion of the front plate 41 is furnished with a through hole 412 for receiving the oarlock 23 of the buoy ring 2. The rear end of the plate 41 has two through holes not shown for mounting a pedal seat 43. The rear plate 42 has a through hole 421 for receiving an oarlock 23 and two through holes not shown on the front thereof for mounting the pedal seat 43, which is substantially a V-shaped frame, having two mounting holes 431 at each end on the top side thereof. The pedal seat 43 is mounted under the front plate 41 and the rear plate 42 by means of an inverted U-shaped bolt 462. The lower end of the pedal seat 43 is furnished with a crank hole 433 for mounting a spindle 441 therein; each end of the spindle 441 has a crank 442 mounted thereon, one end of which has a pedal 45 having an oar plate 451 mounted thereon. In use, the driving force of the present invention is applied to the pedals and the oar plates 451 by a user's feet. The combination of the crank hole 433, the spindle 441, the crank 442 and the pedals 45 in the driving mechanism 4 is deemed an obvious technique being the same as that in a bicycle, and therefore no further details thereof are given. In assembling the device, one end of the front plate 41 is connected with one end of the rear plate 42; the joint portion of the two plates 41 and 42 is covered with a fastening plate 461 that has several mounting holes 4611; then, the inverted U-shaped bolts 462 are inserted into the corresponding through holes aligned respectively, and nuts are mounted on the lower ends of the inverted U-shaped bolts 462 respectively so as to connect the front and rear plates 41 and 42 and the pedal seat 43 into one assembly.

In the aforesaid parts and assemblies, the pad 1, the buoy ring 2 and the pad sheet 3 are all made of many pieces of PVC cloth, being connected to one another by thermal welding, since the PVC cloth has the advantages of light weight, and being flexible for folding and carrying convenience. Further, the aforesaid parts and assemblies may be in different colors for better appearance.

Figure 6:
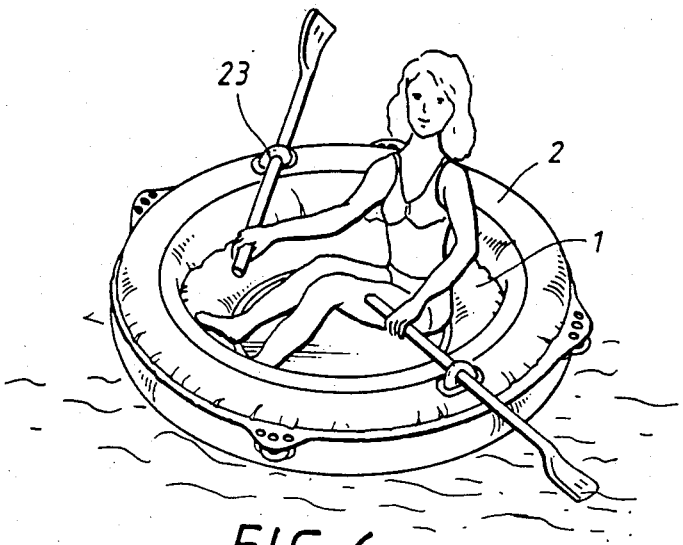
FIG. 6 illustrates the present invention being operated as a one-person boat.

The aforesaid parts and assemblies can be assembled into different recreation equipment through different assembling methods. As shown in FIG. 6, the pad 1 is put inside the buoy ring 2, being retained between the bottom ring 25 and the projection members 24; then, two oars are mounted on the oarlocks 23 respectively to form a single person boat.

Figure 7:
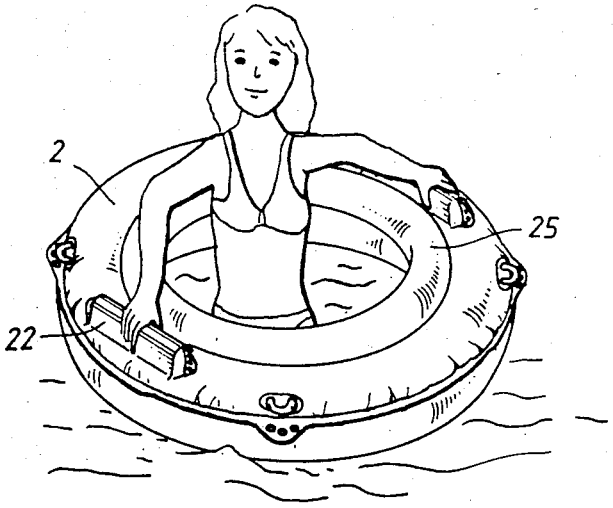
FIG. 7 illustrates the present invention being used as a buoy.

FIG. 7 illustrates the buoy ring 2 has been inverted as a normal life buoy after the pad 1 being removed; the auxiliary air chambers are used as a gripping means.

Figure 8:
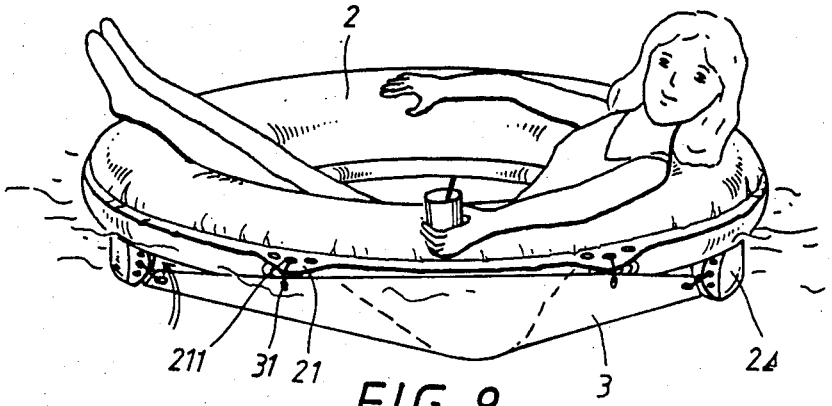
FIG. 8 illustrates the present invention being used as a water hammock.

FIG. 8 illustrates the buoy ring 2 being used as a simple buoy floating on the water with the pad sheet 3 being attached to the bottom of the buoy ring by means of rope or string through the rope holes 31 and the linking holes 211; it is good for a person to lie on. In that case, the buoy ring with the pad sheet is something like an air bed; further, since the joint between the buoy ring 2 and the pad sheet 3 can still let water pass through, the person lying on the buoy ring can enjoy a cool water stream passing around the body portion; such an embodiment may be referred to as a "Water Hammock", which is different from a conventional air hammock.

Figure 9:
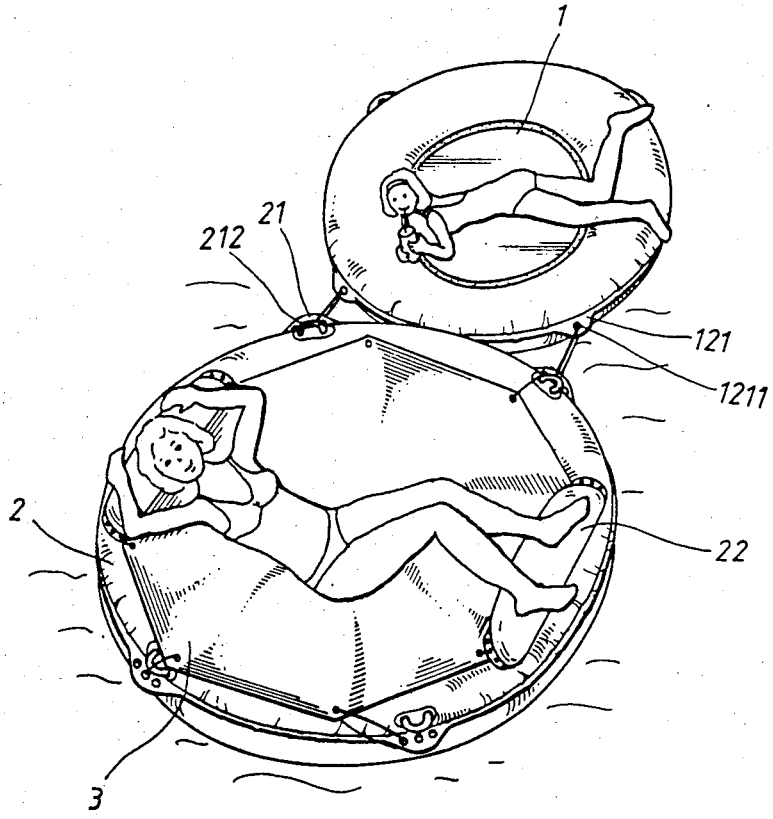
FIG. 9 illustrates the present invention being used as an air bed.

FIG. 9 illustrates two linked air beds, which comprises an inverted buoy ring 2 shown in FIG. 8 and a pad 1 being linked together by means of the linking holes and ropes. In that case, the auxiliary air chambers 22 may be used as a pillow and a foot rest. Such embodiment not only can be used on water, but also can be used on a lawn or the beach.

Figure 10:
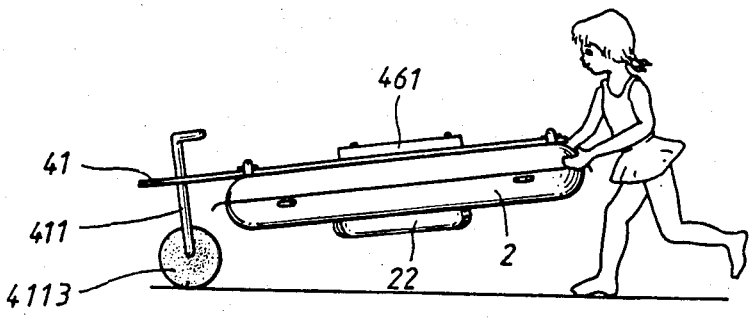
FIG. 10 illustrates the present invention being moved on the ground with the driving mechanism.

FIG. 4 illustrates an embodiment of the present invention being provided with a driving mechanism 4 to form a water bicycle for two persons, which is assembled by mounting the front plate 41 and the rear plate 42, through the holes 412 and 421, on the oarlocks 23 of the buoy ring 2 with fixing pins 47 fitted into the oarlocks 23 respectively so as to mount the driving mechanism 4 on the buoy ring 2. The user can sit on the rear plate 42 to drive the pedals 45 and to control the steering member 411 with the hands, operating the embodiment as a water bicycle for two persons. The buoy ring 2 may be linked with one or more than one pad or buoy ring for carrying a person or other things. Since the driving mechanism 4 has a wheel rotatably mounted on a wheel spindle 4112, the whole embodiment can also be pushed to move on the ground as shown in FIG. 10.

Figure 11:
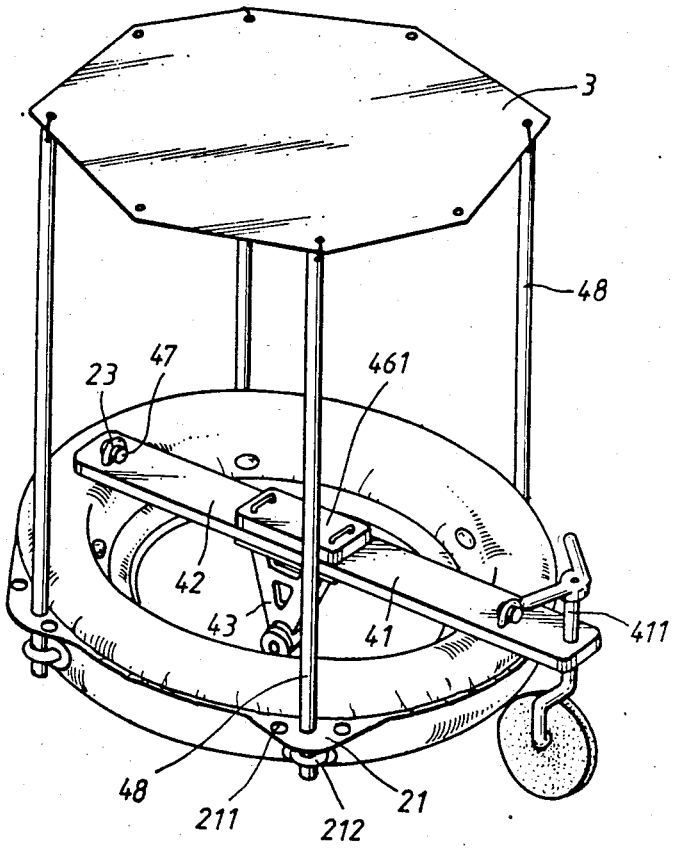
FIG. 11 illustrates the present invention being used as a sunshade.

Referring to FIG. 11, there is another embodiment according to the present invention, in which supporting rods 48 are mounted in the linking holes 211 on the lugs 21 and the linking rings 212; in that case, the lower end of the supporting rod 48 is subject to two opposite forces, i.e., an outwardly pushing force from the outer wall of the buoy ring 2, and an inwardly pulling force from the lug 21 and the linking ring 212; as a result, the supporting rods 48 are firmly mounted around the buoy ring 2; then, the pad sheet 3 is mounted on the top ends of the supporting rods 48 with ropes to form a sunshade as shown in FIG. 11. Such a sunshade can also be used with the aforesaid embodiments other than the water bicycle, or with other assemblies that may be imagined according to the present invention.

Although all the aforesaid embodiments are described as being good for using on the water, it is merely for description convenience without any sense of limitation; in fact, the present invention can also be used on a lawn or beach, or on snow. Particularly, the embodiment shown in FIG. 4 is also a good toboggan on the snow because of the auxiliary air chambers 22 and the steering member 411.

All the aforesaid embodiments are used for recreation purposes; in fact, the present invention can also provide another special use, i.e., the embodiment shown in FIG. 4 or 6 can also be used by a lifeguard or an aquatic product raiser as a transportation means because of its light weight, being easy to assemble.

In the embodiments shown in the drawings, the various members are assembled in a fixed condition for description convenience, but it should not be construed as a limit thereto. Any change or modification made by a person skilled in the art in order to meet consumer's requirements such as the front and rear plates being made into an oblong shape or to be made in one piece should still be within the spirit and scope of the present invention.

Summing up the aforesaid description of the present invention, it is apparent that the simple structure and members of the present invention can provide a plurality of recreation functions for the consumers; moreover, it can also provide other uses such as a vehicle for people who work on water. Therefore, the present invention is deemed to be a novel and practical device in many aspects.

What is claimed is:

1. A multi-function pad device comprising:

a pad member;

a buoy ring member;

a pad sheet member; and a driving mechanism;

said pad member being constituted by an inner ring and an outer ring, and the edge portion of said outer ring having several lugs having linking holes therein for use in linking said pad member with other members, and both said inner and outer rings having discrete air chambers therein and inflating valves therefor;

said buoy ring member being constituted by a ring-shaped inflatable structure, several lugs mounted around the outer edge thereof, each of said lugs having several linking holes therein for using in linking said buoy ring member with other members, and a linking ring under each lug in which a supporting rod can be mounted, and two symmetrical and parallel auxiliary air chambers on the bottom side of said ring-shaped structure at diametrically opposite positions thereon, oarlocks on the top of said ring-shaped structure at diametrically opposite positions thereon for receiving oars therein, and several projections at spaced intervals around the inside surface of said structure and a bottom ring on the lower inside surface of said ring-shaped structure, said pad member being receivable between said projections and said bottom ring;

said pad sheet member being constituted by a polygonal piece of plastic cloth having a suitable toughness and elasticity and having several rope holes along the edge portion thereof for receiving a rope therethrough to convert said pad sheet member into a bag for containing other members of said device for carrying convenience; and said driving mechanism being constituted by a main frame having a front plate and a rear plate having adjacent ends and outer ends, and the outer end of said front plate having a steering member rotatably mounted thereon and which has a handle on the top, a wheel spindle with a wheel on the lower end thereto, and central part of said front plate having a through hole for receiving therethrough an oarlock on said buoy ring member, and the adjacent ends of said front and rear plates having two through holes, and said rear plate having a through hole in the outer end thereof for receiving an oarlock therethrough, a V-shaped pedal seat, both ends of the top of said V-shaped pedal seat having holes, and two inverted U-shaped bolts extending through said plates and the top of said V-shaped pedal seat, and nuts securing said bolts, and the lower end of said V-shaped pedal seat having cranks and pedals at both ends of said cranks, and the front end of each of said pedals having a web-shaped oar plate.

2. A multi-pad device comprising:

a pad member;

a buoy ring member;

a pad sheet member; and a driving mechanism;

said pad member being constituted by an inner ring and an outer ring, and the edge portion of said outer ring having means thereon for use in linking said pad member with other members;

said buoy ring member being constituted by a ring-shaped inflatable structure, means around the outer edge thereof for using in linking said buoy with other members, and two symmetrical and parallel auxiliary air chambers on the bottom side of said ring-shaped structure at diametrically opposite positions thereon, oarlocks on the top of said ring-shaped structure at diametrically opposite positions thereon for receiving oars therein, and several projections at spaced intervals around the inside surface of said structure and a bottom ring on the lower inside surface of said ring-shaped structure, said pad member being receivable between said projections and said bottom ring;

said pad sheet member being constituted by a piece of plastic cloth and having several rope holes along the edge portion thereof for receiving a rope therethrough to convert said pad sheet member into a bag for containing other members of said device for carrying convenience; and said driving mechanism being constituted by a main frame, a steering member rotatably mounted thereon and having a wheel mounted on the steering member on which the pad device is adapted to roll, said main frame having through holes for receiving therethrough the oarlocks on said buoy ring member, and a V-shaped pedal seat secured to said main frame, and the lower end of said V-shaped pedal seat having cranks and pedals at both ends of said cranks, and the front end of said pedals having a web-shaped oar plate.

3. A multi-function pad device comprising:

a pad member;

a buoy ring member;

a pad sheet member; and a driving mechanism;

said pad member being constituted by an inner ring and an outer ring;

said buoy ring member being constituted by a ring-shaped inflatable structure, and two symmetrical and parallel auxiliary air chambers on the bottom side of said ring-shaped structure at diametrically opposite positions thereon, projection means around the inside surface of said structure and a bottom ring on the lower inside surface of said ring-shaped structure, said pad member being receivable between said projection means and said bottom ring;

said pad sheet member being constituted by a piece of plastic cloth which can be shaped to convert said pad sheet member into a bag for containing other members of said device for carrying convenience; and said driving mechanism being constituted by a main frame, a steerable wheel rotatably mounted thereon on which the pad device is adapted to run, means for securing said main frame to said buoy ring member, a pedal seat mounted on said main frame and having a depending portion, and pedal means rotatably mounted on the lower end of said depending portion and having web means thereon.

* * * * *